US010905238B1

(12) United States Patent
Shyu

(10) Patent No.: US 10,905,238 B1
(45) Date of Patent: Feb. 2, 2021

(54) BRACKET FOR DRAWER SLIDE RAIL

(71) Applicant: MasterBrand Cabinets, Inc., Jasper, IN (US)

(72) Inventor: Jenq-Huey Shyu, New Taipei (TW)

(73) Assignee: MASTERBRAND CABINETS, INC, Jasper, IN (US)

( * ) Notice: Subject to any disclaimer, the term of this patent is extended or adjusted under 35 U.S.C. 154(b) by 0 days.

(21) Appl. No.: 16/680,736

(22) Filed: Nov. 12, 2019

(51) Int. Cl.
*A47B 88/43* (2017.01)

(52) U.S. Cl.
CPC ..... *A47B 88/43* (2017.01)

(58) Field of Classification Search
CPC ... A47B 88/423; A47B 88/0418; A47B 88/43; A47B 88/044; A47B 88/407; A47B 88/0407
See application file for complete search history.

(56) References Cited

U.S. PATENT DOCUMENTS

| | | | |
|---|---|---|---|
| 2,587,691 | A | 3/1952 | Brewer |
| 3,090,662 | A | 5/1963 | Dargene |
| 3,149,811 | A | 9/1964 | Fremstad et al. |
| 3,352,617 | A | 11/1967 | Dargene |
| 3,675,833 | A | 7/1972 | Barr |
| 3,750,993 | A | 8/1973 | Read |
| 3,876,270 | A | 4/1975 | White |
| 4,037,897 | A | 7/1977 | Siggia |
| 4,141,525 | A | 2/1979 | Miller |
| 4,176,890 | A | 12/1979 | Gorton |
| 4,201,429 | A | 5/1980 | Collier |
| 4,244,546 | A | 1/1981 | Mertes et al. |
| 4,278,309 | A | 7/1981 | Dreiling |
| 4,289,290 | A | 9/1981 | Miller |
| 4,441,773 | A | 4/1984 | Leiper |
| 5,039,181 | A | 8/1991 | Lautenschlager |
| 5,257,861 | A | 11/1993 | Domenig et al. |
| 5,275,483 | A | 1/1994 | Rasmussen |
| 5,306,080 | A | 4/1994 | Lautenschlager et al. |
| 5,349,723 | A | 9/1994 | Domenig |

(Continued)

FOREIGN PATENT DOCUMENTS

| | | | |
|---|---|---|---|
| CN | 107668987 | A | 2/2018 |
| CN | 109247734 | A | 1/2019 |

(Continued)

*Primary Examiner* — Andrew M Roersma
(74) *Attorney, Agent, or Firm* — Calfee, Halter & Griswold LLP

(57) ABSTRACT

A mounting bracket is provided for securing a drawer slide rail having an elongated rail portion and a bent laterally extending tongue portion having a slotted planar wall extending to upper and lower flanges. The mounting bracket includes a vertically extending base wall having a rail mounting hole for receiving a fastener to secure the slotted planar wall of the tongue portion to the base wall. A plurality of laterally spaced downward oriented upper hook members and upward oriented lower hook members extend from the front surface of the base wall to define laterally extending upper and lower slots for receiving the upper and lower flanges of the tongue portion, and upper and lower gaps between end portions of the upper and lower hook members and the front surface of the base wall for independent gripping engagement of the planar wall of the tongue portion of the drawer slide rail therebetween.

20 Claims, 14 Drawing Sheets

(56) References Cited

U.S. PATENT DOCUMENTS

| | | | |
|---|---|---|---|
| 5,359,752 | A | 11/1994 | Domenig |
| 5,387,033 | A | 2/1995 | Domenig |
| 5,549,376 | A | 8/1996 | Domenig |
| 5,562,333 | A | 10/1996 | Domenig et al. |
| 5,636,820 | A | 6/1997 | Domenig |
| 5,746,490 | A | 5/1998 | Domenig |
| 5,823,648 | A | 10/1998 | Domenig |
| 5,842,759 | A | 12/1998 | Ferrari et al. |
| D442,077 | S | 5/2001 | Crooks et al. |
| 6,302,502 | B1 | 10/2001 | Larsen |
| 6,367,900 | B1 | 4/2002 | Woerner |
| 6,494,550 | B1 | 12/2002 | Chen et al. |
| D469,001 | S | 1/2003 | Branson |
| 6,733,098 | B1 | 5/2004 | Branson |
| 6,757,937 | B2 | 7/2004 | Salice |
| 6,757,938 | B1 | 7/2004 | di Vinadio |
| 6,837,557 | B2 | 1/2005 | Domenig |
| 7,090,320 | B2 | 8/2006 | Chen |
| 7,331,644 | B2 | 2/2008 | Lowe |
| 7,625,051 | B1 | 12/2009 | Kim |
| 8,141,966 | B2 | 3/2012 | Placke et al. |
| 8,616,664 | B2 | 12/2013 | Hightower |
| 8,876,232 | B2 | 11/2014 | Anderson et al. |
| 8,911,037 | B2 | 12/2014 | Hightower |
| 9,375,084 | B2 | 6/2016 | Lachman et al. |
| 9,398,808 | B2 | 7/2016 | Anderson et al. |
| 9,549,613 | B2 | 1/2017 | Hightower |
| 2005/0264146 | A1* | 12/2005 | Fitz ..... A47B 88/423 312/334.5 |
| 2018/0242736 | A1 | 8/2018 | Duggins et al. |

FOREIGN PATENT DOCUMENTS

| | | | |
|---|---|---|---|
| EP | 791313 | A1 | 8/1997 |
| EP | 1380231 | A1 | 1/2004 |
| EP | 1709886 | A1 | 10/2006 |
| EP | 2742826 | A1 | 6/2014 |

* cited by examiner

BRACKET FOR DRAWER SLIDE RAIL

BACKGROUND

Rear-mounted drawer slide rails are often used in furniture (e.g., cabinets, desks) for which one or more drawers are disposed in a space wider than the drawers, such that there is not a side frame or wall on which the slide rail may be mounted.

SUMMARY OF THE DISCLOSURE

In an exemplary embodiment of the present disclosure, a mounting bracket is provided for securing a drawer slide rail having an elongated rail portion and a bent laterally extending tongue portion having a slotted planar wall extending to upper and lower flanges. The mounting bracket includes a vertically extending base wall having a rail mounting hole for receiving a fastener to secure the slotted planar wall of the tongue portion to the base wall. A plurality of laterally spaced downward oriented upper hook members and upward oriented lower hook members extend from the front surface of the base wall to define laterally extending upper and lower slots for receiving the upper and lower flanges of the tongue portion, and upper and lower gaps between end portions of the upper and lower hook members and the front surface of the base wall for independent gripping engagement of the planar wall of the tongue portion of the drawer slide rail therebetween.

In another exemplary embodiment of the present disclosure, a drawer slide rail is provided in combination with a mounting bracket for securing the drawer slide rail to a furniture article. The drawer slide rail includes an elongated rail portion and a bent laterally extending tongue portion having a planar wall extending to upper and lower flanges and including a laterally extending slot. The mounting bracket includes a vertically extending base wall having a rail mounting hole receiving a fastener extending through the laterally extending slot of the drawer slide rail tongue portion to secure the planar wall of the tongue portion to the base wall. A plurality of laterally spaced downward oriented upper hook members and upward oriented lower hook members extend from the front surface of the base wall to define laterally extending upper and lower slots receiving the upper and lower flanges of the tongue portion, and upper and lower gaps between end portions of the upper and lower hook members and the front surface of the base wall receiving the planar wall of the tongue portion. The end portions of the upper and lower hook members independently grip the planar wall of the tongue portion.

BRIEF DESCRIPTION OF THE DRAWINGS

Further features and advantages of the invention will become apparent from the following detailed description made with reference to the accompanying drawings, wherein.

DETAILED DESCRIPTION

This Detailed Description merely describes exemplary embodiments and is not intended to limit the scope of the claims in any way. Indeed, the invention as claimed is broader than and unlimited by the described embodiments, and the terms used have their full ordinary meaning.

Figure 1:
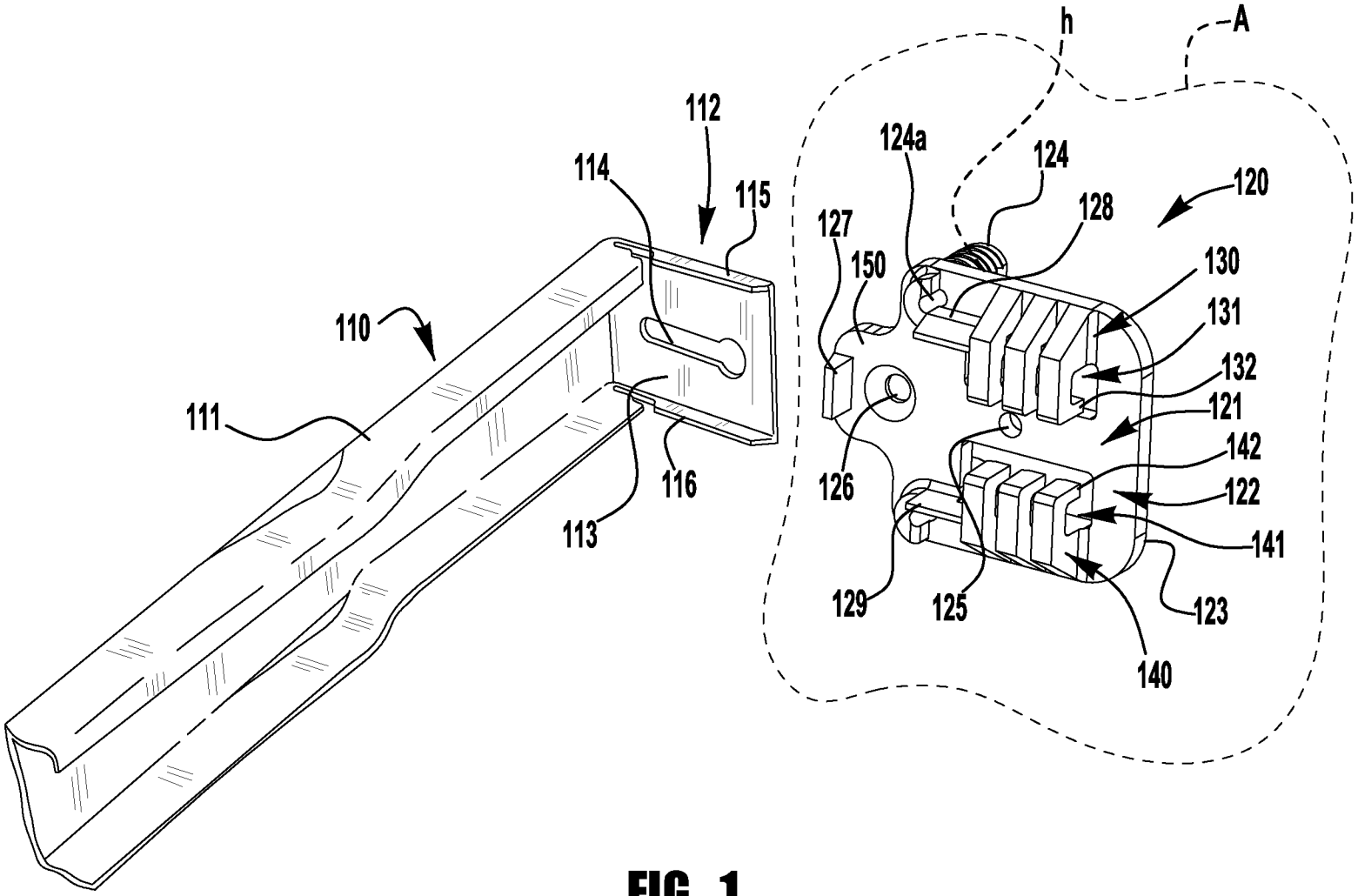
FIG. 1 is an exploded perspective view of a drawer slide rail and a mounting bracket for mounting a rear portion of the drawer slide rail to a rear wall of a furniture item, according to an exemplary embodiment of the present disclosure.

FIG. 1 illustrates an exploded or disassembled perspective view of an exemplary drawer slide rail 110 and mounting bracket 120 for securing the drawer slide rail to a rear wall of a furniture article (e.g., cabinet, desk), shown in phantom at A. The exemplary drawer slide rail 110 includes an elongated rail portion 111 and a tongue portion 112 bent at an approximately 90° angle from the rail portion 111. The tongue portion 112 includes a planar wall 113 defining a laterally extending slot 114, and upper and lower flanges 115, 116 bent forward from the planar wall.

Figure 2:
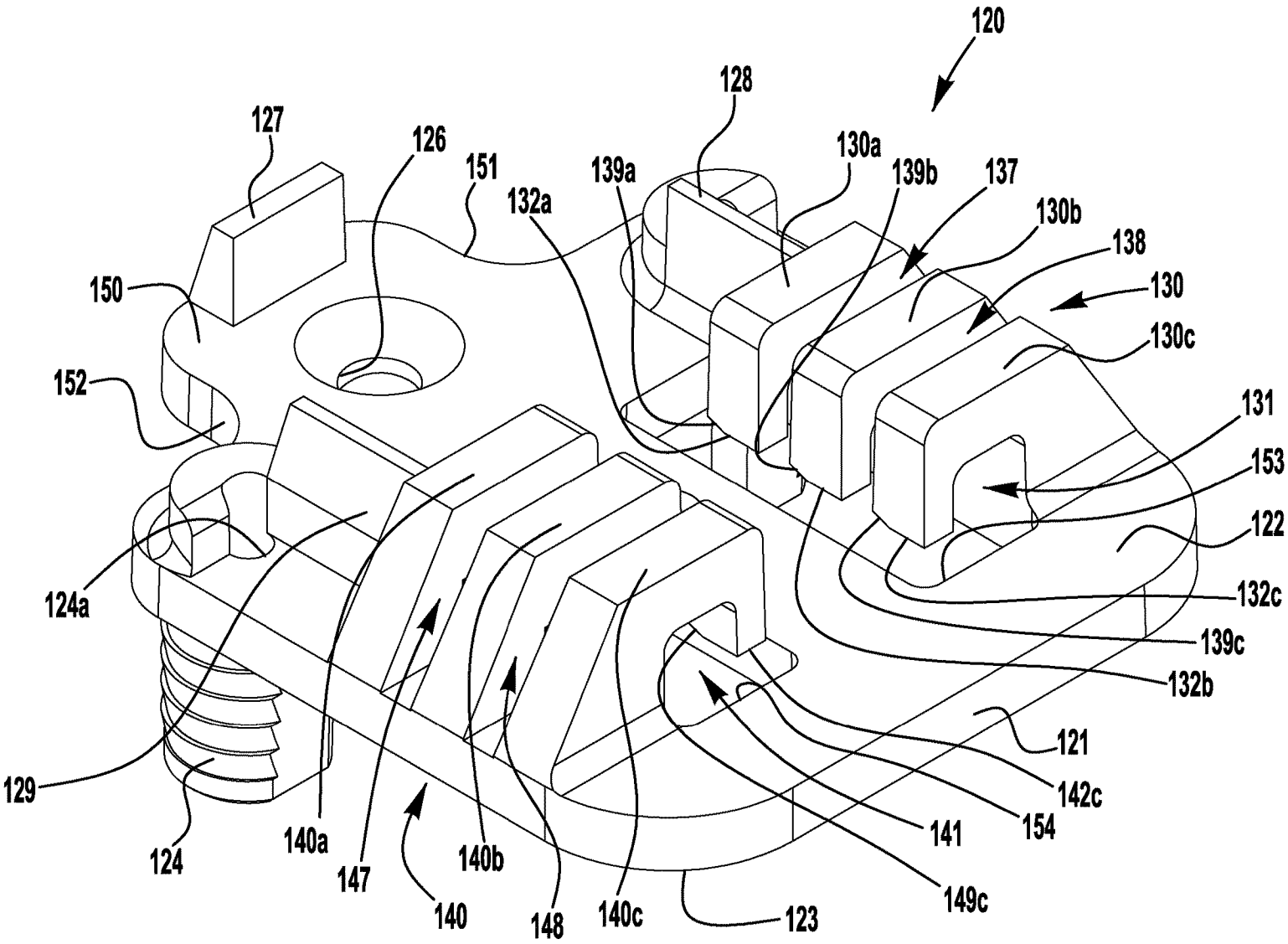
FIG. 2 is a front perspective view of the mounting bracket of FIG. 1.

The exemplary mounting bracket 120, as shown in FIGS. 2, 2 A, and 2B, includes a vertically extending (as secured to furniture article A) base wall 121 having a front surface 122 and a rear surface 123 opposite the front surface. Mounting posts 124 (e.g., threaded mounting posts to enhance grip with the mounting holes) extend from the rear surface 123 for installation in corresponding mounting holes h in the furniture article A. The mounting posts 124 may define mounting holes 124*a* for installing fasteners, for example, to further anchor the mounting bracket to the furniture article A. While the exemplary mounting bracket 120 includes two mounting posts 124, in other embodiments, a different number of mounting posts (e.g., one, or three or more) may be used, or a different mounting arrangement (e.g., fasteners, adhesive) may be used. In the illustrated embodiment, a rail mounting hole 125 and a bracket mounting hole 126 are provided in the base wall 121 to receive fasteners 105, 106 to further secure the mounting bracket 120 to the furniture article A.

To attach the drawer slide rail tongue portion 112 to the mounting bracket 120, the rail mounting hole 125 is alignable with the laterally extending slot 114 in the tongue portion 112. In one such exemplary arrangement, the fastener 105 may be slightly loosened to allow for lateral adjustment of the tongue portion 112 on the mounting bracket 120 to a desired lateral position, and further tightened to secure the tongue portion 112 in this desired lateral position. As shown, an end portion of the laterally extending slot 114 may be enlarged to receive the head of the fastener 105 therethrough, thus permitting installation of the tongue portion 112 onto the mounting bracket 120 without removing the fastener 105.

The exemplary mounting bracket 120 further includes opposed upper and lower hook portions 130, 140 extending from the front surface 122 of the base wall 121 and defining upper and lower slots 131, 141 for receiving the upper and lower flanges 115, 116 of the tongue portion 112 and end portions 132, 142 gripping against the planar wall 113 when the flanges are slid into the upper and lower slots. Upper and lower side walls 128, 129 extend from the front surface 122 of the base wall 121 laterally outward from the hook portions 130, 140 for engaging upper and lower surfaces of the elongated rail portion 111, for example, to further secure the elongated rail portion against vertical movement.

According to an exemplary aspect of the present disclosure, the upper and lower hook portions may include a plurality of laterally spaced upper and lower hook members to provide for independent gripping engagement by the hook members at a plurality of locations on the planar wall of the drawer slide rail tongue portion. One advantage of such an arrangement is that in the event the tongue portion is slightly bent, warped, or otherwise deformed, the hook members may independently flexible to maintain multiple engagement points with the tongue portion.

In the illustrated embodiment, the upper hook portion 130 includes first, second and third laterally spaced, downward oriented upper hook members 130*a*, 130*b*, 130*c* defining the upper slot 131, with end portions 132*a*, 132*b*, 132*c* spaced apart from the front surface 122 of the base wall 121 to define an upper gap 133 for receiving the planar wall 113 of the tongue portion 112. Likewise, the lower hook portion 140 includes first, second and third laterally spaced, downward oriented lower hook members 140*a*, 140*b*, 140*c* defining the lower slot 141, with end portions 142*a*, 142*b*, 142*c* spaced apart from the front surface 122 of the base wall 121 to define a lower gap 143 (which may be the same as the upper gap 133) for receiving the planar wall 113 of the tongue portion 112. In other embodiments, a different number of hook members may be provided (e.g., two hook members, or four or more hook members) to provide a different number of discrete engagement points with the tongue portion. The upper and lower hook portions may each include the same number of hook members (e.g., four upper hook members and four lower hook members) or a different number of hook members (e.g., four upper hook members and three lower hook members).

Figure 3:
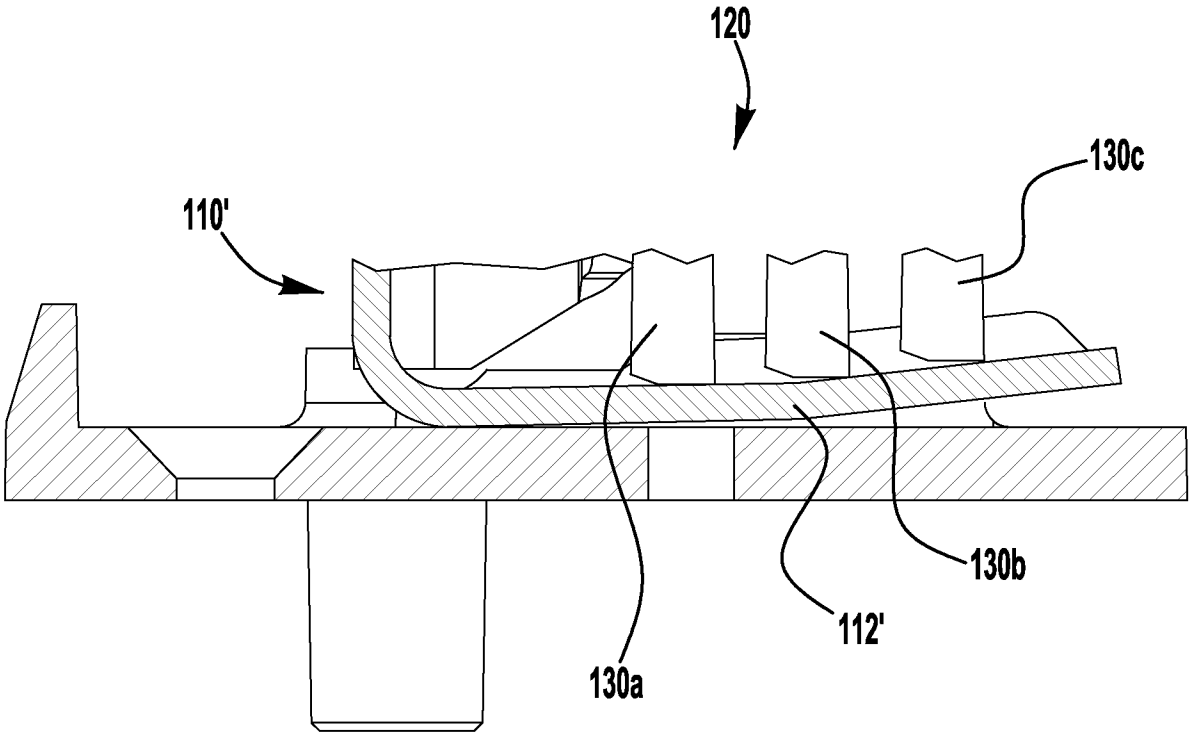
FIG. 3 is a partial bottom cross-sectional view of the drawer slide rail and mounting bracket of FIG. 1, showing multi-point engagement of the gripping prongs of the mounting bracket with the bent tongue portion of the drawer slide rail.

FIG. 3 illustrates a partial bottom cross-sectional view of the exemplary mounting bracket 120 assembled with a drawer slide rail 110' having a deformed tongue portion 112'. As shown, the hook members 130*a-c* are independently flexible to maintain multiple engagement points between the hook member end portions 132*a-c* and the tongue portion 112'.

Figure 2A:
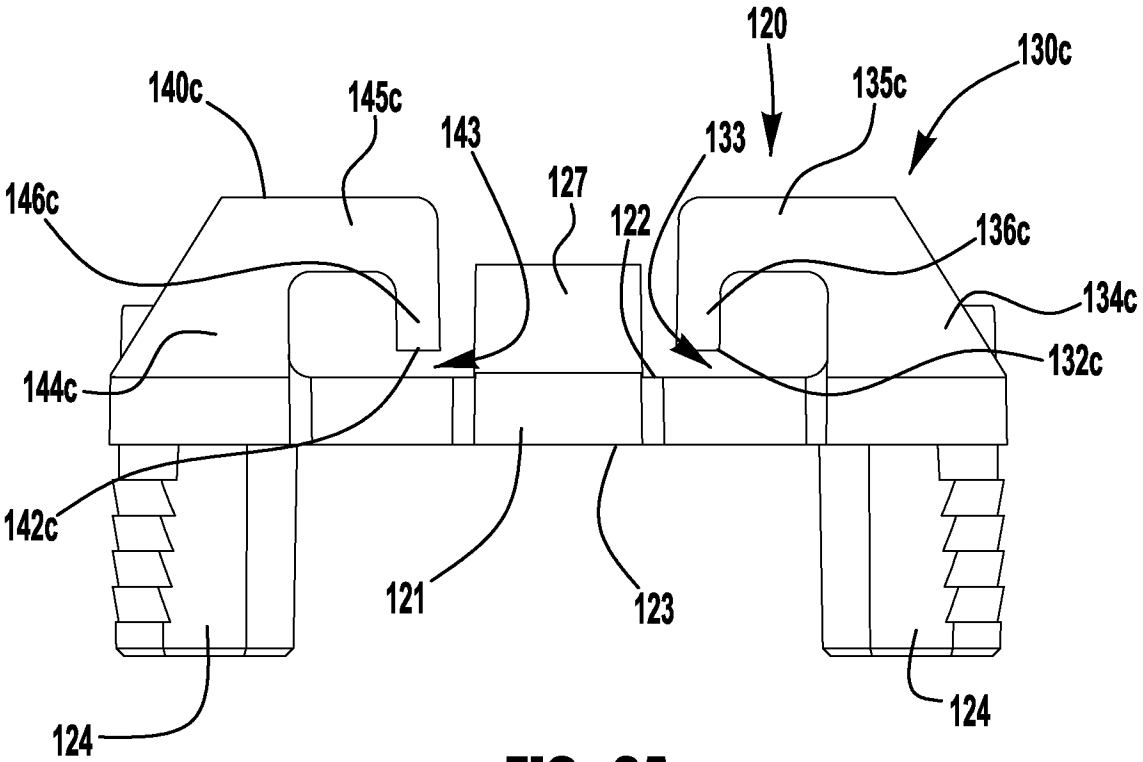
FIG. 2A is a side cross-sectional view of the mounting bracket of FIG. 1.

The hook members may be provided in a variety of shapes or configurations. In the illustrated example, as shown in the cross-sectional view of FIG. 2A, each of the plurality of upper hook members 130*a-c* includes a first portion 134*a-c* extending outward from the front surface 122 of the base wall 121, a second portion 135*a-c* extending downward from a forward end of the first portion 134*a-c*, and a third portion 136*a-c* extending inward (i.e., toward the front surface 122) from a lower end of the second portion 135*a-c* to define the end portion 132*a-c* of the upper hook member 130*a-c*. Likewise, each of the plurality of lower hook members 140*a-c* comprises a first portion 144*a-c* extending outward from the front surface 122 of the base wall 121, a second portion 145*a-c* extending upward from a forward end of the first portion 144*a-c*, and a third portion 146*a-c* extending inward (i.e., toward the front surface 122) from an upper end of the second portion 145*a-c* to define the end portion 142*a-c* of the lower hook member 140*a-c*.

Figure 2B:
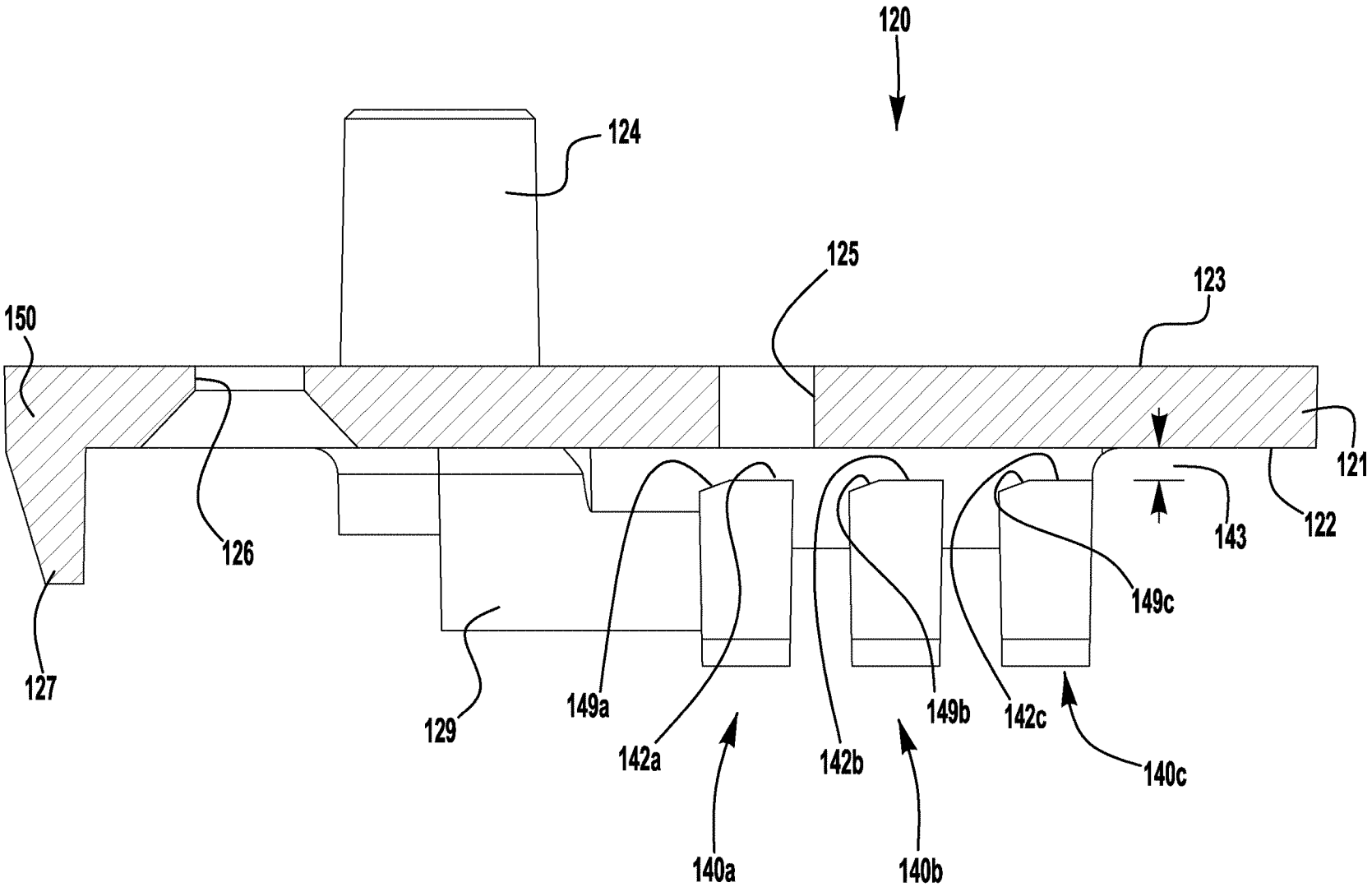
FIG. 2B is a top cross-sectional view of the mounting bracket of FIG. 1.

As evident in FIGS. 2 and 2B, the hook members 130*a-c*, 140*a-c* may be spaced apart from each other by lateral gaps 137, 138, 147, 148 that are smaller than a lateral thickness of the hook members. In other embodiments (not shown), the hook members may be spaced apart from each other by lateral gaps that are larger than or equal to the lateral thickness of the hook members.

The end portions 132*a-c*, 142*a-c* may each be provided with a chamfered lateral end 139*a-c*, 149*a-c* proximate to an outer lateral end 150 of the mounting bracket 120, for example, to facilitate receipt of the distal end 118 of the tongue portion 112 between the hook member end portions 132*a-c*, 142*a-c* and the base wall 121 during assembly of the drawer slide rail 110 with the mounting bracket 120.

Figure 4:
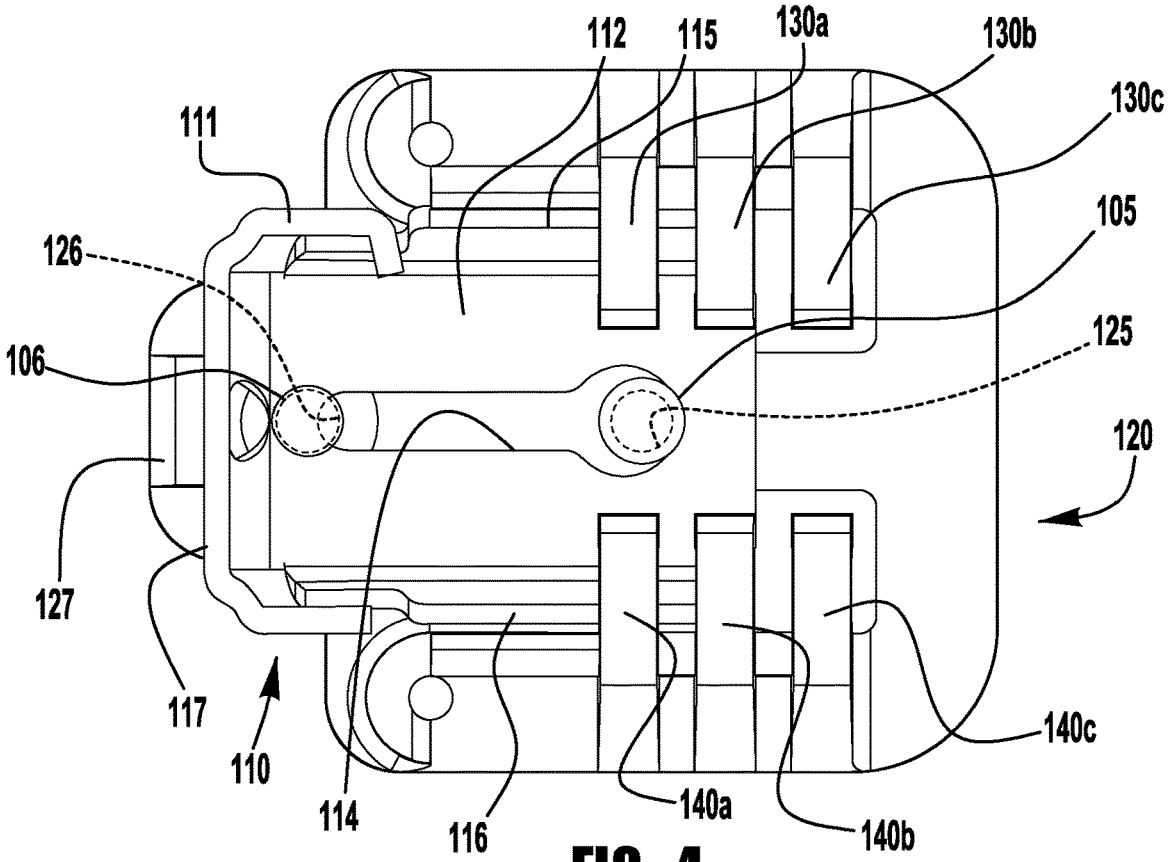
FIG. 4 is a front view of the drawer slide rail and mounting bracket of FIG. 1, with the bent tongue portion of a drawer slide rail assembled with the mounting bracket in a first lateral limit position.

While the range of lateral limit positions may be limited only by the ends of the laterally extending slot in the tongue portion of the drawer slide rail, in other embodiments, the mounting bracket may be configured to limit lateral adjustment along a range of lateral positions between first (or outermost) and second (or innermost) lateral limit positions. In the illustrated embodiment, the outer lateral end 150 of the mounting bracket 120 includes a stop wall 127 that engages a proximal or bent end 117 of the tongue portion 112 to define a first lateral limit position of the tongue portion in a withdrawing direction (FIG. 3). According to another aspect of the present disclosure, the hook members may be positioned or otherwise configured to maintain sufficient gripping engagement of the hook members 130*a-c*, 140*a-c* against the tongue portion 112, for example, to provide sufficient rigid support for the drawer slide rail 110. As shown in FIG. 4, when the tongue portion 112 is in the outermost lateral limit position, with the bent end 117 of the tongue portion engaging the stop wall 127, the tongue portion may remain aligned with a plurality (e.g., two, or in other embodiments, more than two) of the upper and lower hook members 130*a*, 130*b*, 140*a*, 140*b*, to maintain a plurality of engagement points against the upper and lower ends of the tongue portion 112. As shown in FIG. 4, this first lateral limit position may (but need not) also coincide with abutment of the fastener 105 with the enlarged end of the tongue portion slot 114, for example, to provide additional surface abutment for the first lateral limit position.

Figure 5:
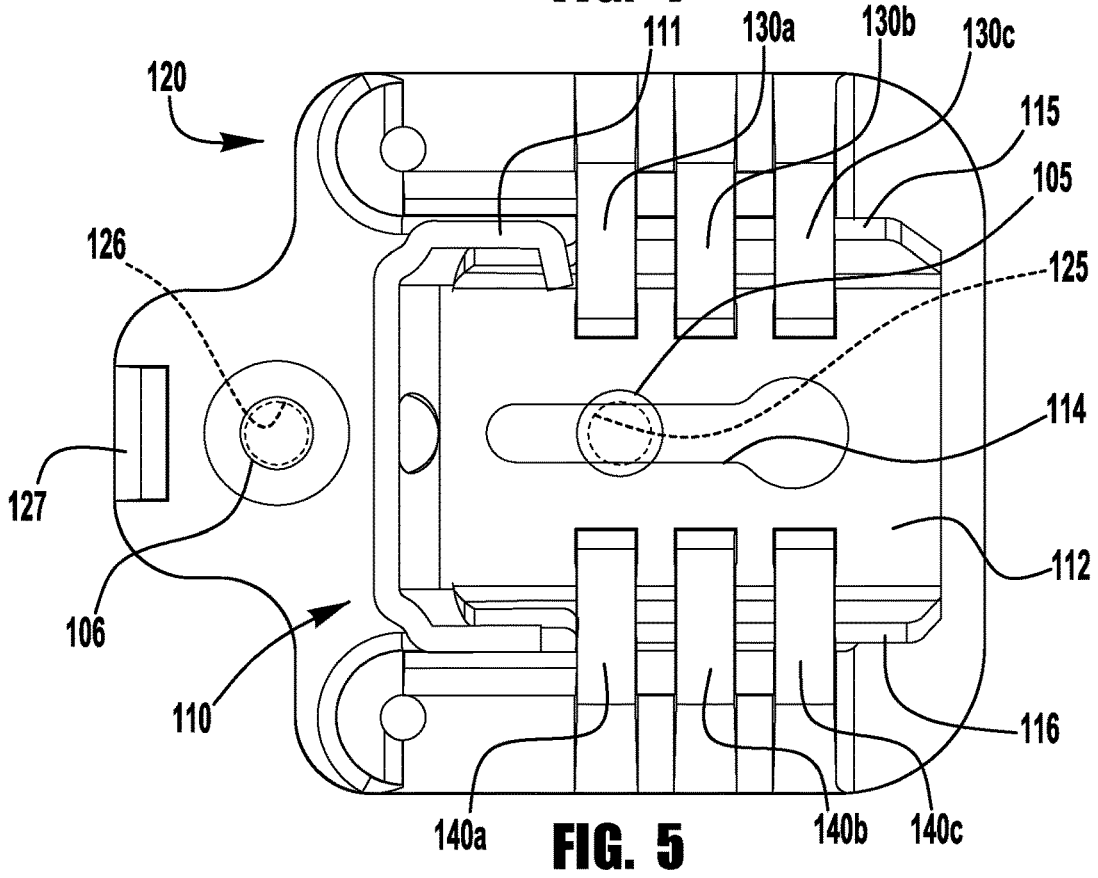
FIG. 5 is a front view of the drawer slide rail and mounting bracket of FIG. 1, with the bent tongue portion of the drawer slide rail assembled with the mounting bracket in a second lateral limit position.
Figure 6:
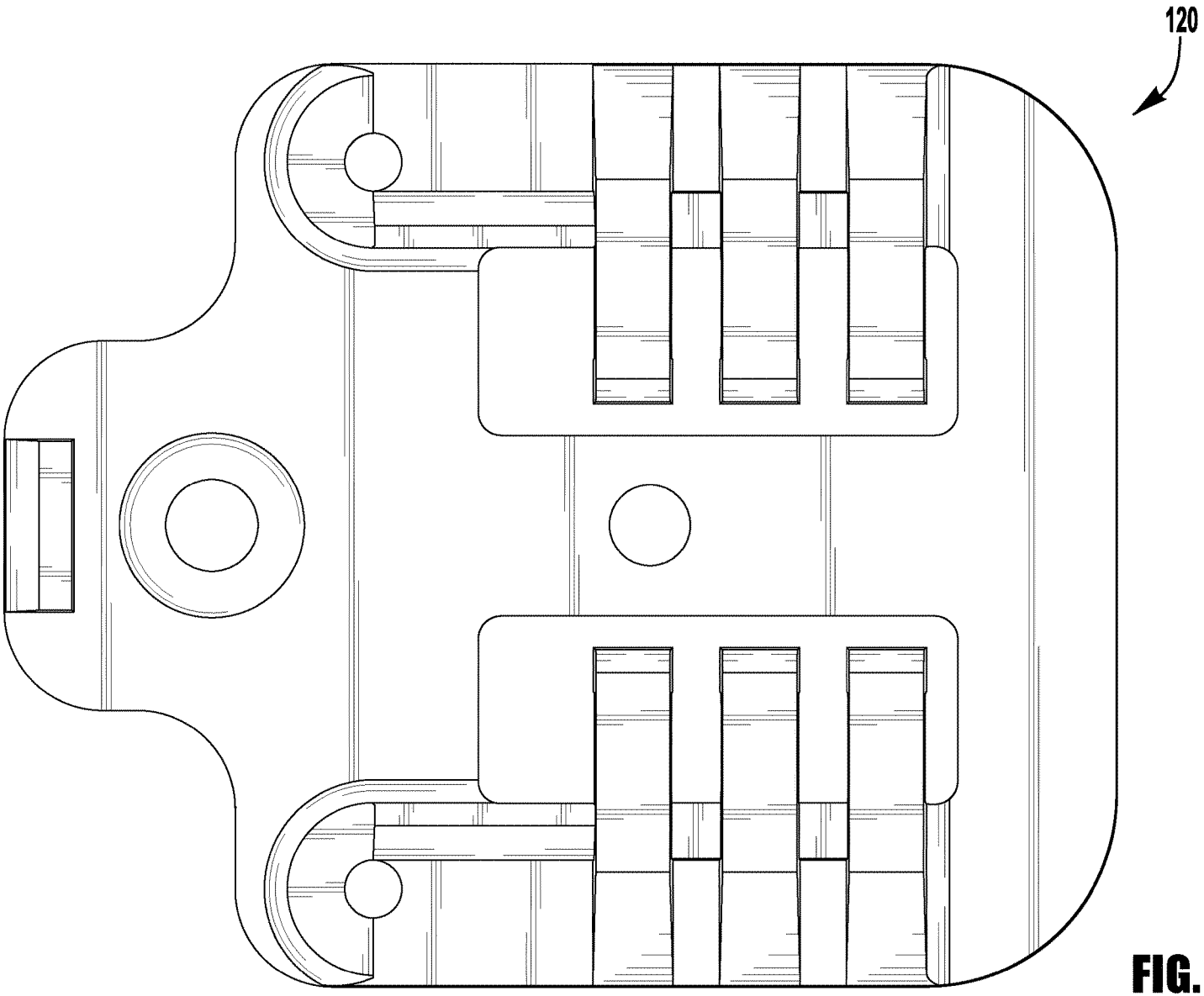
FIG. 6 is a front elevational view of a mounting bracket, according to an exemplary embodiment of the present disclosure.
Figure 7:
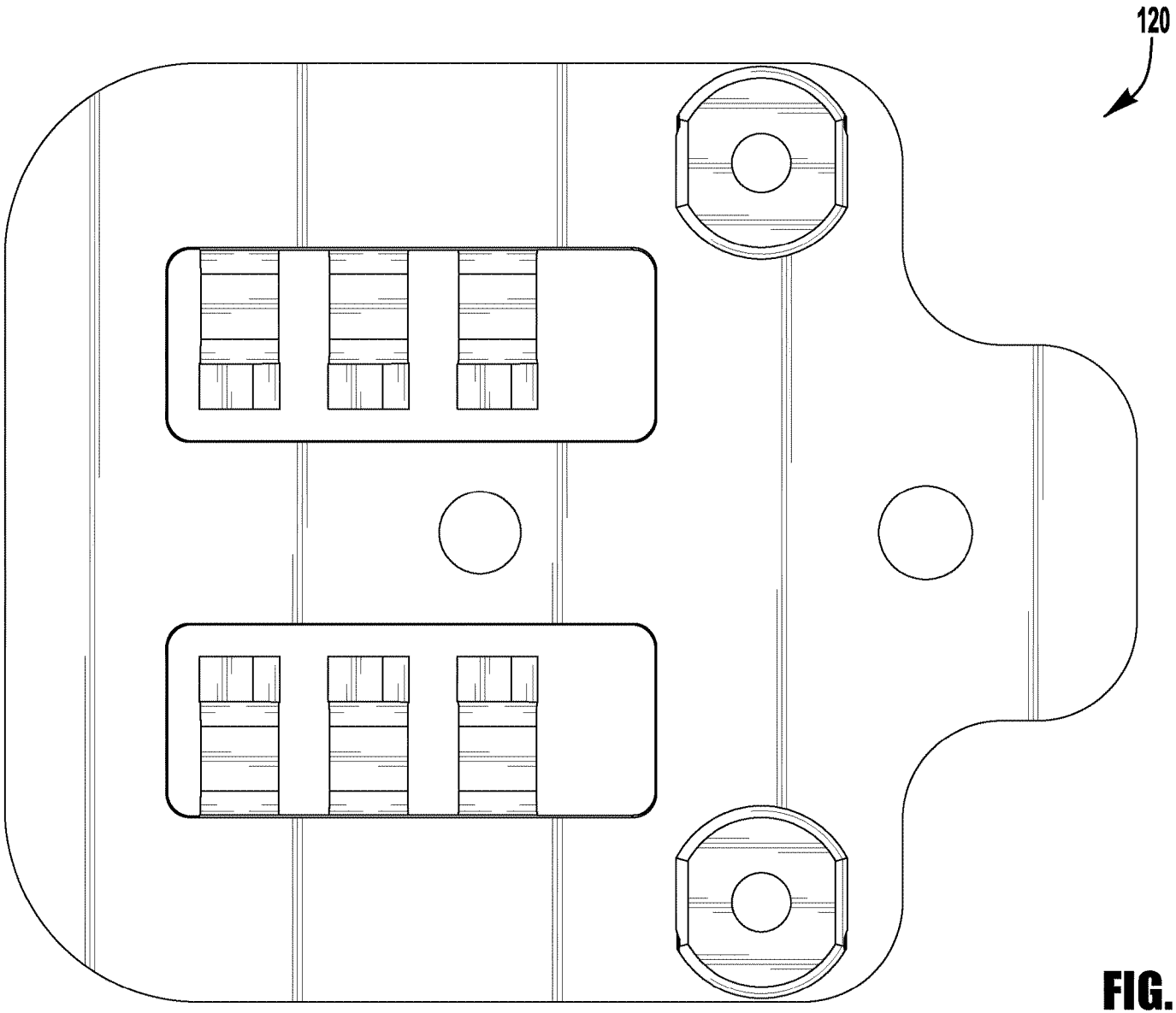
FIG. 7 is a rear elevational view thereof.
Figure 8:
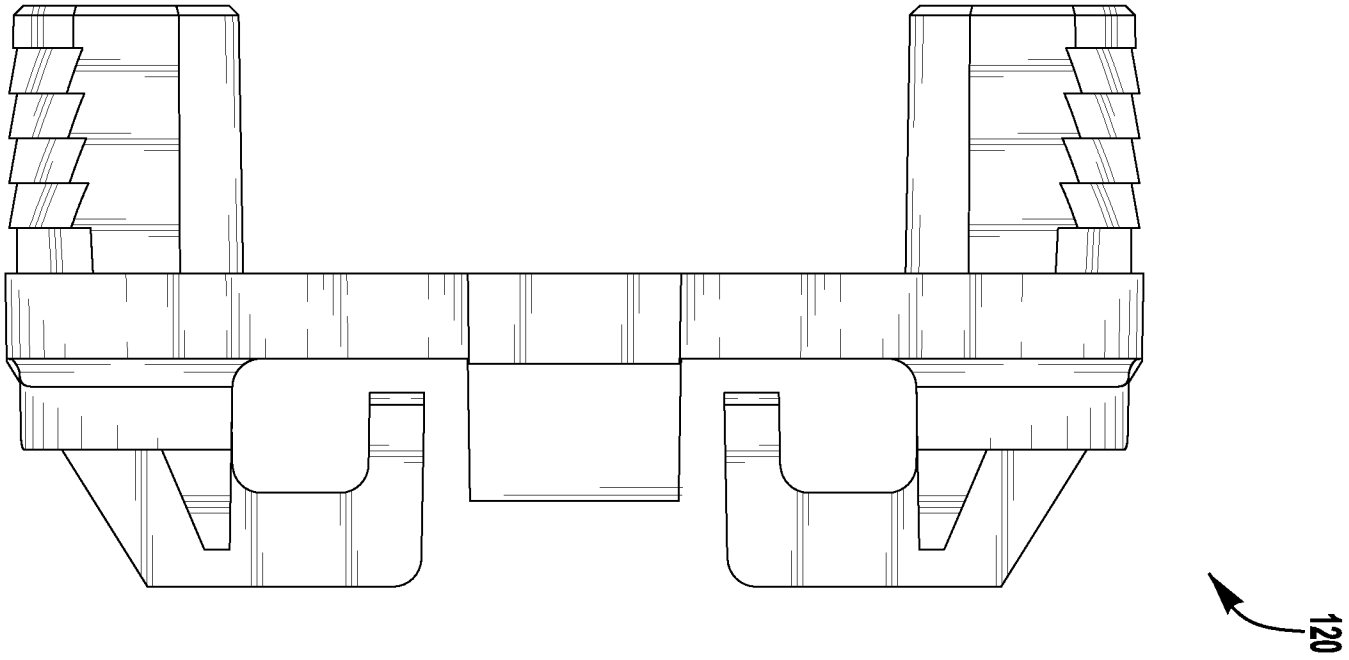
FIG. 8 is a left side elevational view thereof.
Figure 9:
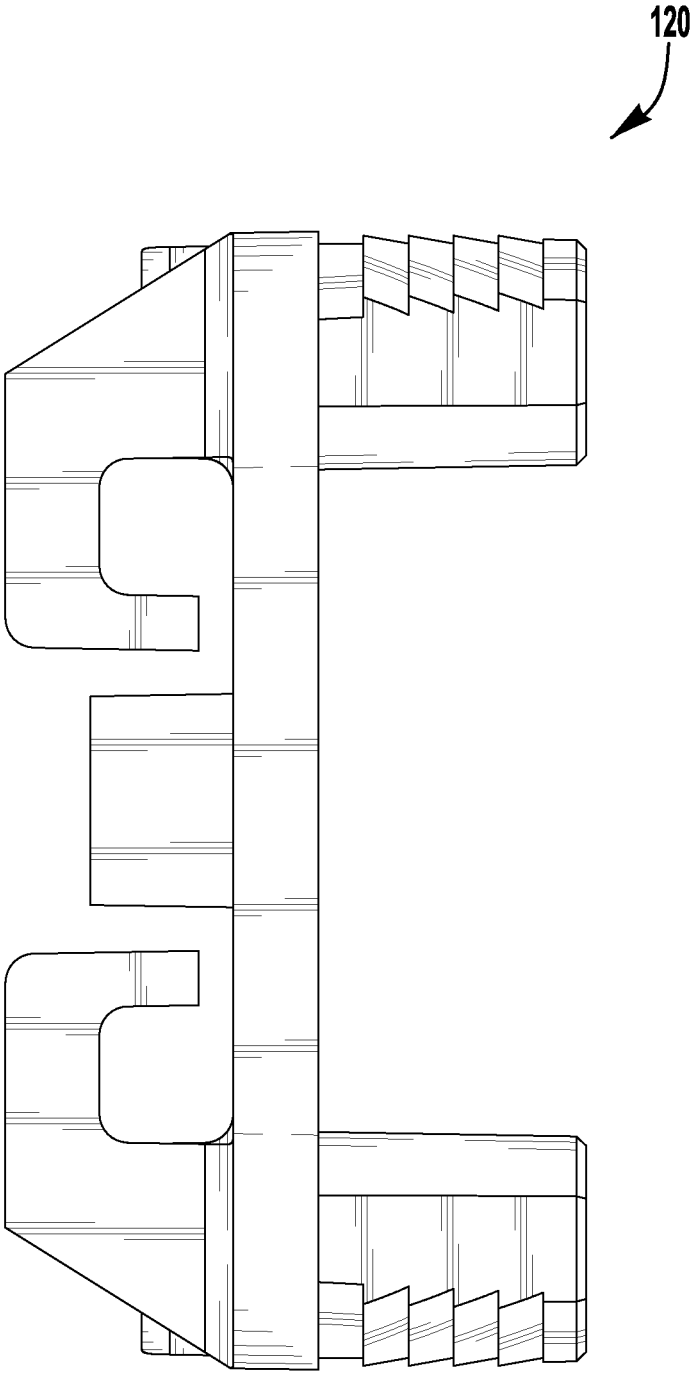
FIG. 9 is a right side elevational view thereof.
Figure 10:
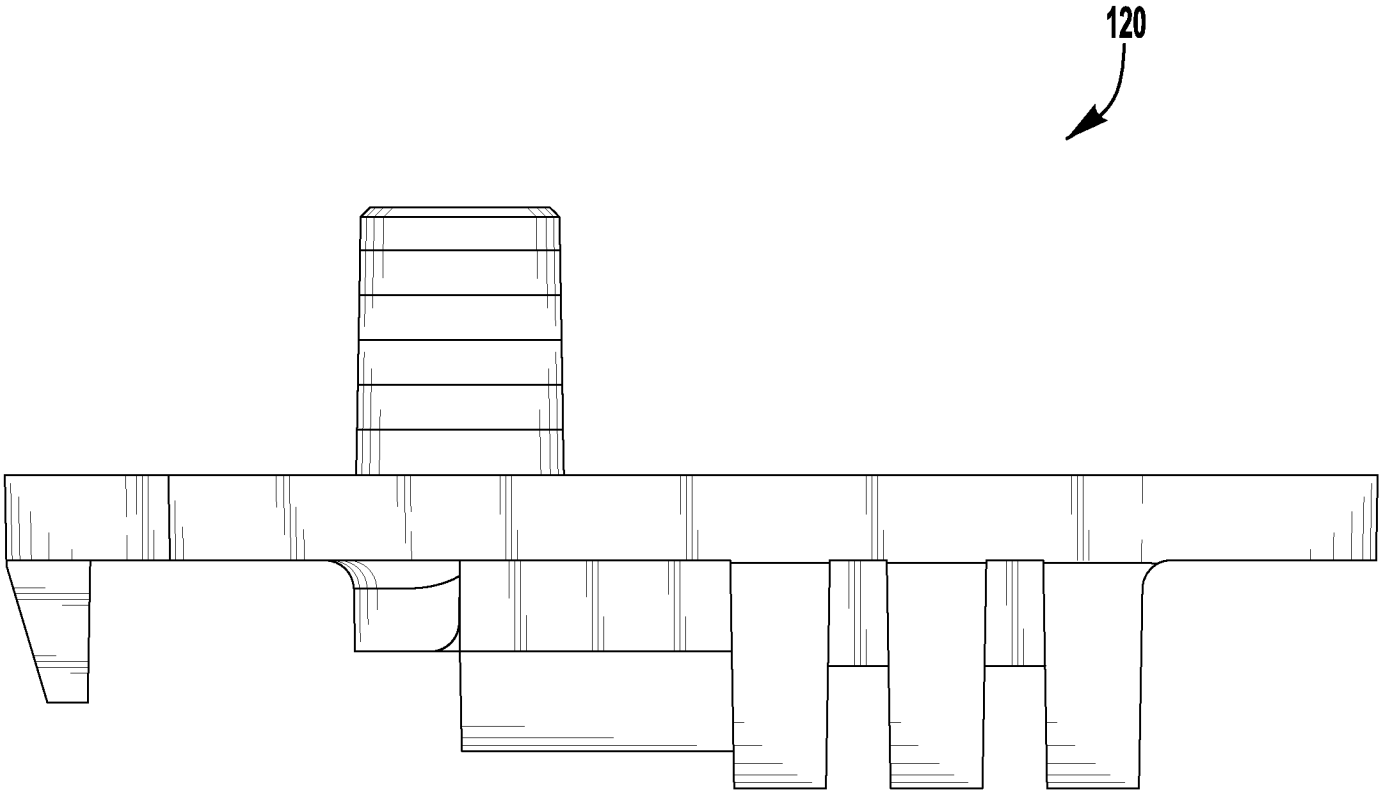
FIG. 10 is a top plan view thereof.
Figure 11:
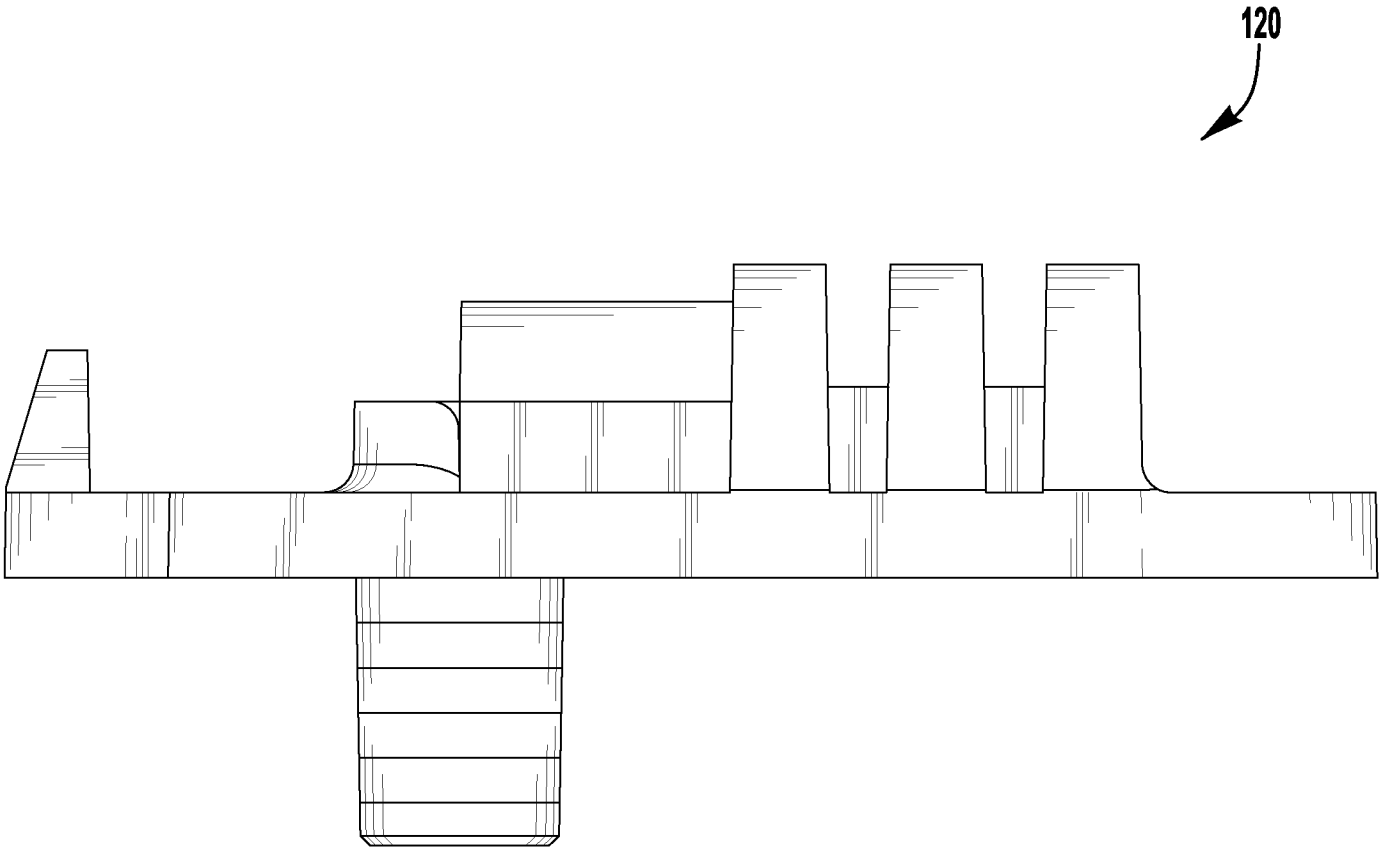
FIG. 11 is a bottom plan view thereof.
Figure 12:
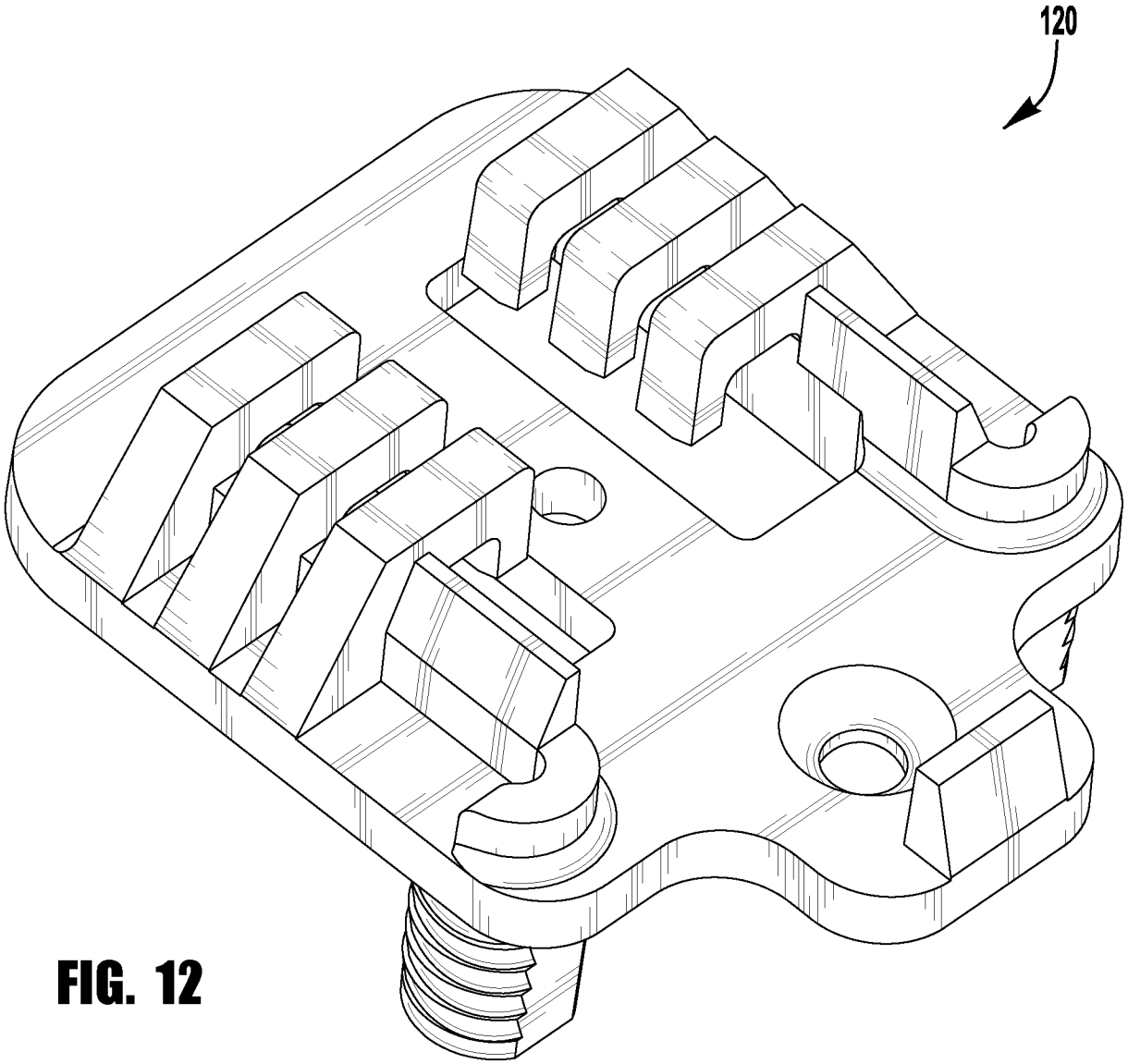
FIG. 12 is a front perspective view thereof.
Figure 13:
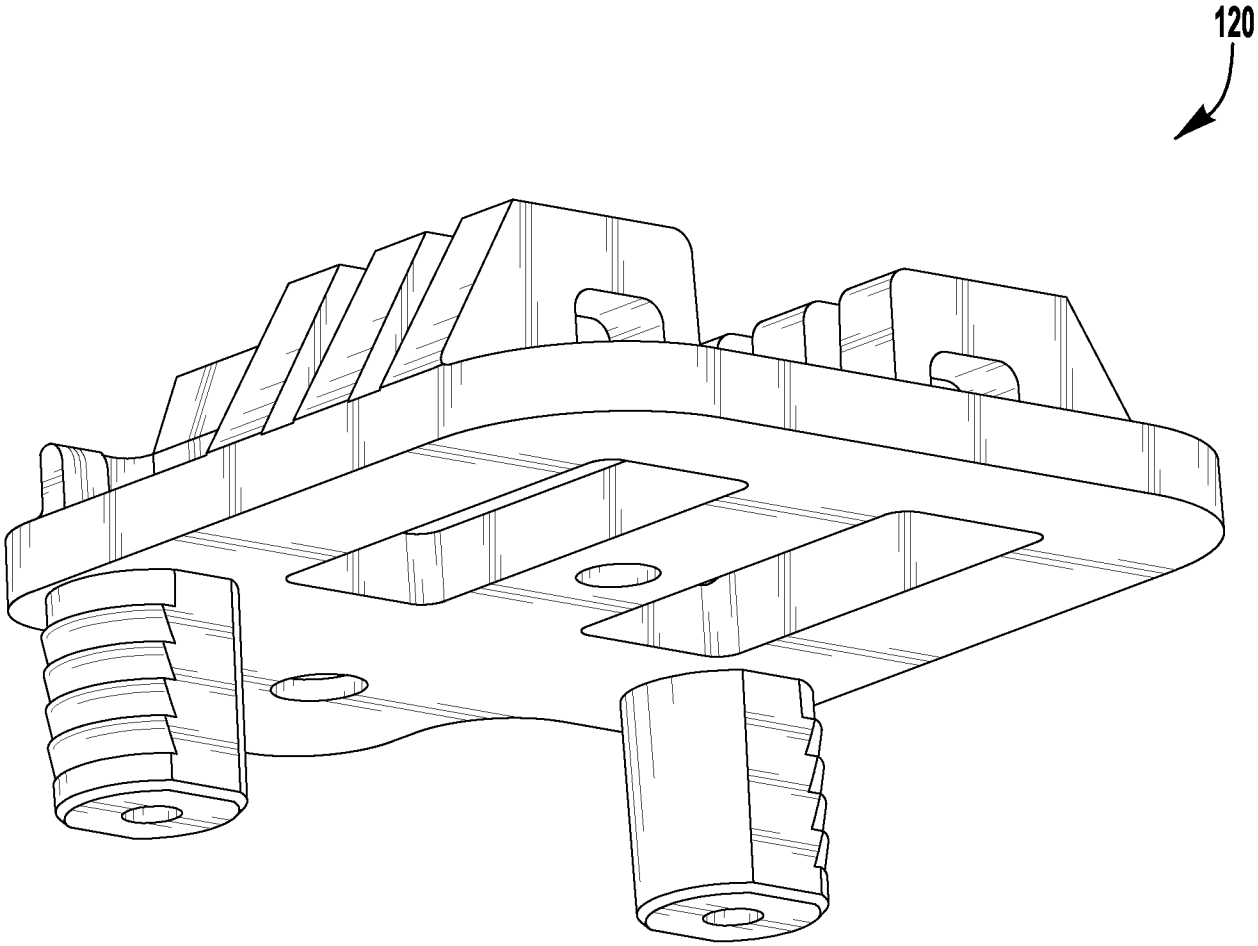
FIG. 13 is a rear perspective view thereof.

FIG. 5 illustrates the drawer slide rail 110 assembled with the mounting bracket 120 in the innermost lateral limit position. In the exemplary embodiment, the second lateral limit position is defined by engagement of the elongated rail portion 111 with the endmost upper hook member 130*a*. In other embodiments, the elongated rail portion may engage the endmost lower hook member, or the endmost upper and lower hook members. In other embodiments, other limit defining portions may be provided, such as, for example, an end wall extending from the base wall front surface for engagement with a distal end of the tongue portion.

According to an exemplary aspect of the present disclosure, the bracket may be adapted to be a lightweight component that provides for rigid, robust retention of the drawer slide rail. For example, the bracket 120 may include cutouts 151, 152 adjacent to the stop wall 127 and cutouts 153, 154 adjacent to the hook portions 130, 140, as shown in FIG. 2. Additionally or alternatively, the bracket may be constructed from a lightweight yet durable material, such as, for example, ABS plastic. In some such embodiments, the bracket may have a weight that is at least about 30% less than a conventional plastic bracket for a rear mounted drawer slide rail.

FIGS. 6-13 illustrate various additional views of an exemplary design for the mounting bracket 120.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Further, it is to be understood that the drawings accompanying the present disclosure may, but need not, be to scale, and therefore may be understood as teaching various ratios and proportions evident in the drawings. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

What is claimed is:

1. A mounting bracket for securing a drawer slide rail, the drawer slide rail having an elongated rail portion and a bent laterally extending tongue portion having a slotted planar wall extending to upper and lower flanges, the mounting bracket comprising:

a vertically extending base wall having a front surface and a rear surface opposite the front surface, and including a rail mounting hole for receiving a fastener to secure the slotted planar wall of the tongue portion of the drawer slide rail to the base wall;

a plurality of laterally spaced downward oriented upper hook members extending from the front surface of the base wall, and disposed on a first lateral side of a lateral midpoint of the mounting bracket, to define a laterally extending upper slot for receiving the upper flange of the tongue portion of the drawer slide rail and upper gaps between end portions of the upper hook members and the front surface of the base wall for independent gripping engagement of the planar wall of the tongue portion of the drawer slide rail therebetween; and a plurality of laterally spaced upward oriented lower hook members extending from the front surface of the base wall, and disposed on the first lateral side of the lateral midpoint of the mounting bracket, to define a laterally extending lower slot for receiving the lower flange of the tongue portion of the drawer slide rail and lower gaps between end portions of the lower hook members and the front surface of the base wall for independent gripping engagement of the planar wall of the tongue portion of the drawer slide rail therebetween.

2. The mounting bracket of claim 1, further comprising an upper side wall extending from the front surface of the base wall laterally outward from a first one of the upper hook members for engaging an upper surface of the elongated rail portion, and a lower side wall extending from the front surface of the base wall laterally outward from a first one of the lower hook members for engaging a lower surface of the elongated rail portion.

3. The mounting bracket of claim 1, further comprising a stop wall extending from the front surface of the base wall and disposed on a second lateral side of the lateral midpoint of the mounting bracket, opposite the first lateral side, for engaging a bent end of the tongue portion of the drawer slide rail to define a maximum withdrawal of the tongue portion from the upper and lower hook members when the slotted planar wall of the tongue portion is fastened to the base wall of the mounting bracket.

4. The mounting bracket of claim 1, wherein each of the end portions of the upper and lower hook members includes a chamfered lateral end proximate to an outer lateral end of the mounting bracket.

5. The mounting bracket of claim 1, wherein the plurality of upper hook members comprises three upper hook members.

6. The mounting bracket of claim 1, wherein the plurality of lower hook members comprises three lower hook members.

7. The mounting bracket of claim 1, wherein adjacent ones of the plurality of upper hook members are spaced apart by a gap smaller than a lateral thickness of each of the plurality of upper hook members, and adjacent ones of the plurality of lower hook members are spaced apart by a gap smaller than a lateral thickness of each of the plurality of lower hook members.

8. The mounting bracket of claim 1, wherein each of the plurality of upper hook members comprises a first portion extending outward from the front surface of the base wall, a second portion extending downward from a forward end of the first portion, and a third portion extending inward from a lower end of the second portion to define the end portion of the upper hook member, and each of the plurality of lower hook members comprises a first portion extending outward from the front surface of the base wall, a second portion extending upward from a forward end of the first portion, and a third portion extending inward from an upper end of the second portion to define the end portion of the lower hook member.

9. The mounting bracket of claim 1, further comprising at least one mounting post extending from the rear surface of the base wall.

10. In combination, a drawer slide rail and a mounting bracket for securing the drawer slide rail to a furniture article, the drawer slide rail comprising an elongated rail portion and a bent laterally extending tongue portion having a planar wall extending to upper and lower flanges and including a laterally extending slot, the mounting bracket comprising:

a vertically extending base wall having a front surface and a rear surface opposite the front surface, and including a rail mounting hole receiving a fastener extending through the laterally extending slot of the drawer slide rail tongue portion to secure the planar wall of the tongue portion to the base wall;

a plurality of laterally spaced downward oriented upper hook members extending from the front surface of the base wall, and disposed on a first lateral side of a lateral midpoint of the mounting bracket, to define a laterally extending upper slot receiving the upper flange of the tongue portion of the drawer slide rail and upper gaps between end portions of the upper hook members and the front surface of the base wall receiving the planar wall of the tongue portion, with the end portions of the upper hook members independently gripping the planar wall of the tongue portion; and a plurality of laterally spaced upward oriented lower hook members extending from the front surface of the base wall, and disposed on the first lateral side of the lateral midpoint of the mounting bracket, to define a laterally extending lower slot receiving the lower flange of the tongue portion of the drawer slide rail and lower gaps between end portions of the lower hook members and the front surface of the base wall receiving the planar wall of the tongue portion, with the end portions of the lower hook members independently gripping the planar wall of the tongue portion.

11. The combination of claim 10, wherein the mounting bracket further comprises an upper side wall extending from the front surface of the base wall laterally outward from a first one of the upper hook members and engaging an upper surface of the elongated rail portion, and a lower side wall extending from the front surface of the base wall laterally outward from a first one of the lower hook members and engaging a lower surface of the elongated rail portion.

12. The combination of claim 10, wherein the mounting bracket further comprises a stop wall extending from the front surface of the base wall and disposed on a second lateral side of the lateral midpoint of the mounting bracket, opposite the first lateral side, for engaging a bent end of the tongue portion of the drawer slide rail to define a first lateral limit position of the tongue portion.

13. The combination of claim 12, wherein when the tongue portion of the drawer slide rail is in the first lateral limit position, at least two of the plurality of upper hook members and at least two of the plurality of lower hook members remain in gripping engagement with the planar wall of the tongue portion.

14. The combination of claim 12, wherein when the tongue portion of the drawer slide rail is in the first lateral limit position, the fastener engages an edge of the laterally extending slot of the drawer slide rail tongue portion.

15. The combination of claim 12, wherein the elongated rail portion of the drawer slide rail is engageable with an endmost one of at least one of the plurality of upper and lower look portions to define a second lateral limit position of the tongue portion.

16. The combination of claim 10, wherein each of the end portions of the upper and lower hook members includes a chamfered lateral end proximate to an outer lateral end of the mounting bracket.

17. The combination of claim 10, wherein the plurality of upper hook members comprises three upper hook members, and the plurality of lower hook members comprises three lower hook members.

18. The combination of claim 10, wherein adjacent ones of the plurality of upper hook members are spaced apart by a gap smaller than a lateral thickness of each of the plurality of upper hook members, and adjacent ones of the plurality of lower hook members are spaced apart by a gap smaller than a lateral thickness of each of the plurality of lower hook members.

19. The combination of claim 10, wherein each of the plurality of upper hook members comprises a first portion extending outward from the front surface of the base wall, a second portion extending downward from a forward end of the first portion, and a third portion extending inward from a lower end of the second portion to define the end portion of the upper hook member, and each of the plurality of lower hook members comprises a first portion extending outward from the front surface of the base wall, a second portion extending upward from a forward end of the first portion, and a third portion extending inward from an upper end of the second portion to define the end portion of the lower hook member.

20. The combination of claim 12, wherein the plurality of upper hook members comprises three upper hook members, and the plurality of lower hook members comprises three lower hook members, wherein when the tongue portion of the drawer slide rail is in the first lateral limit position, two of the plurality of upper hook members and two of the plurality of lower hook members remain in gripping engagement with the planar wall of the tongue portion.

* * * * *